United States Patent [19]

Grainger

[11] Patent Number: 4,977,731

[45] Date of Patent: Dec. 18, 1990

[54] METHOD OF CONSTRUCTING MASONRY PANELS

[75] Inventor: Oswald J. Grainger, deceased, late of Houston, Tex., by Arlene E. Grainger, legal representative

[73] Assignee: Bruce Grainger, Houston, Tex.

[21] Appl. No.: 413,715

[22] Filed: Sep. 28, 1989

[51] Int. Cl.[5] ..... E04B 1/40; E04B 1/00

[52] U.S. Cl. ..... 52/747; 52/743

[58] Field of Search ..... 52/743, 745, 747, 749, 52/125.1–125.6

[56] References Cited

U.S. PATENT DOCUMENTS 3,287,782 11/1966 McClarney ..... 52/743
4,709,526 12/1987 Crumby ..... 52/749

FOREIGN PATENT DOCUMENTS 723350 12/1965 Canada ..... 52/747
607915 4/1978 U.S.S.R. ..... 52/745

*Primary Examiner*—Richard E. Chilcot, Jr.
*Assistant Examiner*—Deborah McGann Ripley
*Attorney, Agent, or Firm*—Larry Mason Lee

[57] ABSTRACT

A method for constructing masonry (brick, thin brick, tile, marble, stone, etc.) panels. Masonry units are placed face-down on an adhesive-coated positioning board, joint control means are applied, and a standard tilt-wall or precast panel construction is accomplished. Removal of the positioning board, adhesive, and joint control means results in a standard masonry faced wall panel which may be grouted.

4 Claims, 1 Drawing Sheet

METHOD OF CONSTRUCTING MASONRY PANELS

SUMMARY OF THE INVENTION a. Field Of Invention

The present invention relates to a method of constructing masonry faced tilt-up or pre-cast wall panels.

b. Background Of The Invention

For many years the construction industry has tried to develop a method of economically constructing masonry faced tilt-up or pre-cast wall panels. Both standard sized masonry units and special, thin masonry units have been tried, problems of non-adherence of the masonry units to the wall structure have been encountered, and unacceptable costs have been incurred.

Accordingly, it is the primary object of this invention to provide a method of constructing masonry faced tilt-up or pre-cast wall panels.

It is a further object of this invention to provide a method of constructing masonry faced tilt-up or pre-cast wall panels which is economical.

It is another object of this invention to provide a method of constructing masonry faced tilt-up or pre-cast wall panels which may utilize either full-sized or thin masonry units.

It is yet another object of this invention to provide a method of constructing masonry faced tilt-up or pre-cast wall panels which reliably produces a masonry faced tilt-up or pre-cast wall panel having solid adherence of the masonry units to the structure of the wall panel.

These and other objects and advantages of the present invention will become apparent after considering the following detailed specification which describes the method of the present invention in conjunction with the accompanying drawings.

DESCRIPTION OF THE PREFERRED EMBODIMENT

Figure 1:
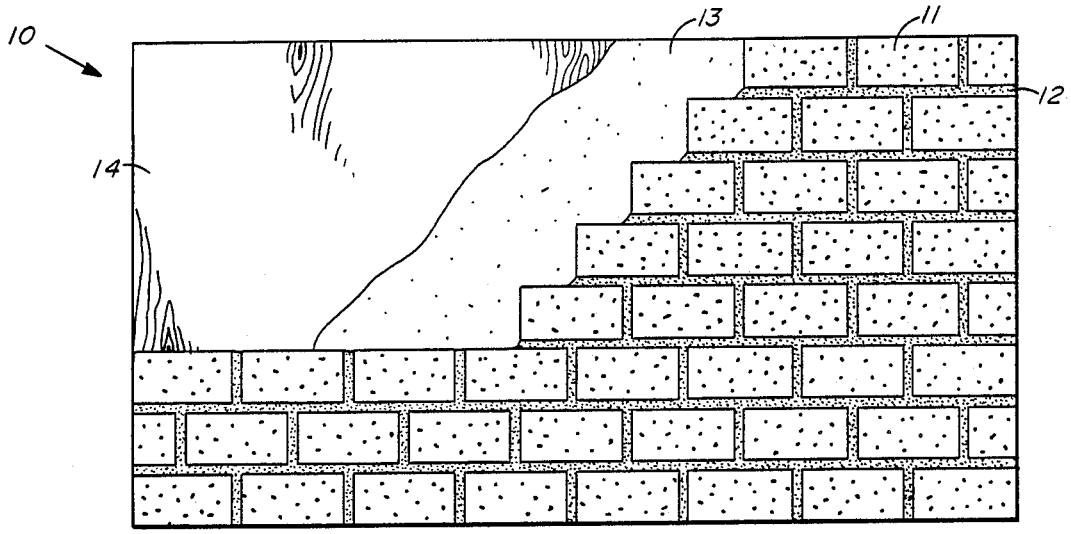
FIG. 1 is a vertical, partially cut away, view of masonry units after placement on an adhesive-coated positioning board.
Figure 2:
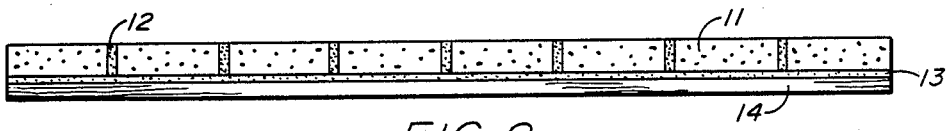
FIG. 2 is a horizontal view of masonry units after placement on an adhesive-coated positioning board.

Reference is made to FIG. 1 for an easy comprehension of the method of the instant invention. In practice, the method requires placement of masonry units (11) face-down upon a level positioning board (14) which has been coated with adhesive (13). Following placement of the masonry units (11) upon the positioning board (14), joint-control means (12) are applied in order to prevent concrete from filling the spaces between the masonry units (11) and thus achieve a controlled joint (variable from fully raked or tooled to flush) during the following steps of the construction of a masonry faced tilt-up or pre-cast wall panel.

In the drawings, a brick is depicted as the masonry unit (11); however, the method of the present invention is useful for all commonly utilized masonry units. Further, FIG. 1 depicts the positioning board (14) as a sheet of plywood, although numerous other materials may be used.

In the drawings, and the preferred embodiment, sand is utilized as the joint-control means (12). However, numerous materials may be successfully substituted for sand as a material to maintain the controlled joint between the masonry units (11). The material chosen in the preferred embodiment as the joint-control means (12) has the advantage of serving as an effective barrier to concrete (19) encroaching upon the surface of the masonry units (11) which would thereby mar the appearance of the finished panel.

The particular adhesive (13) chosen is a function of the particular type of masonry unit (11) selected and the material utilized for the positioning board (14). When the positioning board (14) is plywood, as in the preferred embodiment, all wood glues commonly used in construction appear to suffice for successful practice of the method.

Figure 3:
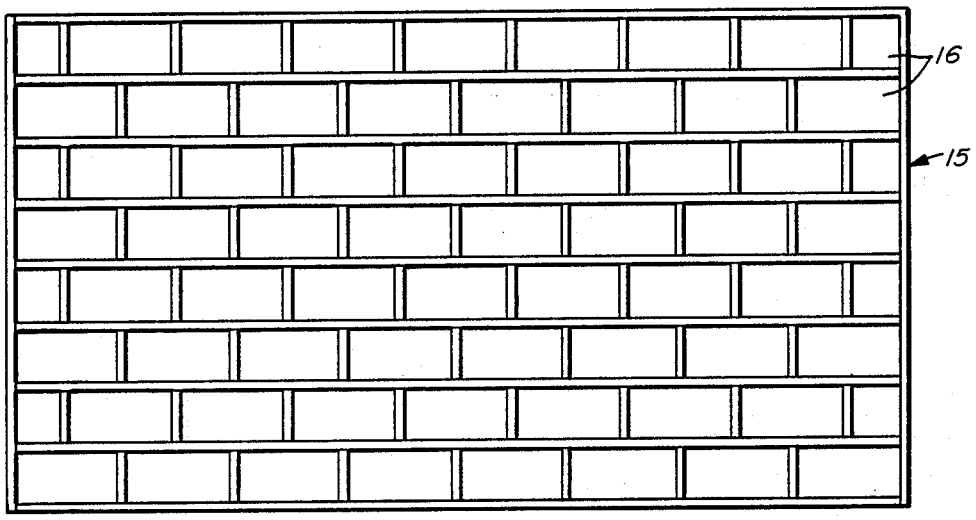
FIG. 3 is a vertical view of a positioning grid which may be utilized in the placement of masonry units upon an adhesive-coated positioning board.

FIG. 3 depicts a positioning means (15) which in the preferred embodiment is simply a grid of voids (16) constructed of welded iron. Clearly the positioning means may be of numerous shapes and materials and may simply be free-form or hand placement of masonry units (11) in a desired pattern. However, the preferred embodiment of the method being disclosed is for use of the method in a mass-production environment and therefore the positioning means (15) of the preferred embodiment is a grid constructed of rigid material which is placed on top of the adhesive (13) coated positioning board (14), into the voids (16) of which grid is placed the masonry units (11), and which grid is removed before application or insertion of the joint control means (12).

Figure 4:
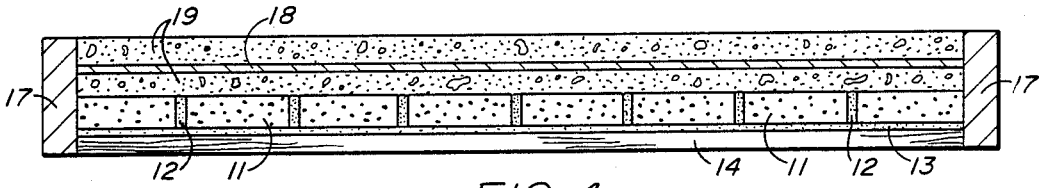
FIG. 4 is a horizontal, sectional view of masonry units on an adhesive-coated positioning board within a concrete pouring form with joint-control means, concrete and reinforcing bars in place.

As depicted in FIG. 4, following removal of the positioning means (15) and application of the joint control means (12), a pouring form (17) is placed around the positioning board (14). Structural reinforcement rods (18) are then placed within the pouring form (17), above the masonry units (11), in the conventional fashion and concrete (19) is poured into the pouring form (17).

After the concrete (19), as shown in FIG. 4, has dryed, the pouring form (17) is removed, the wall is tilted up, and the positioning board (14) is removed.

The final step of the method is removal of the adhesive (13) and joint control means (12) from the face of the masonry units (11) and between the masonry units (11). In the preferred embodiment such removal of the adhesive (13) and joint control means (12) is accomplished simultaneously by spraying the face of the masonry-faced wall panel with a high pressure stream of fluid or vapor (hot or cold water, or steam).

The masonry-faced wall panel which results from construction in accordance with the practice of the instant method is a masonry faced concrete wall panel, which may be grouted if desired, and which meets all architectural and design requirements for a masonry faced tilt-up or pre-cast concrete wall panel constructed in accordance with standard construction methods.

A masonry faced panel (10) may be separately constructed for practice of the method describe herein. Said masonry faced panel (10) is constructed in accordance with the steps of the instant method preceding the placement of pouring form (17) around the positioning board (14).

A double-sided or two-faced masonry faced tilt-up or pre-cast concrete wall panel can be constructed utilizing the instant method by fastening or adhering two masonry faced wall panels, constructed pursuant to the instant method, back-to-back; or by placing two masonry faced panels (10) inside a vertical pouring form, adjacent to the walls of said form, with the masonry units (11) of said masonry faced panels (10) facing outwardly and then completing the steps of the instant method in the vertical pouring space between the masonry faced panels (10).

The method of the preferred embodiment is very economical and has the additional advantage of being simple to accomplish, thereby reliably producing a uniform quality masonry faced tilt-up or pre-cast concrete wall panel.

This invention has been described in terms of single preferred embodiment, however numerous embodiments are possible without departing from the essential characteristics thereof. Accordingly, the description has been illustrative and not restrictive as the scope of the invention is defined by the appended claims, not by the description preceding them, and all changes and modifications that fall within the stated claims or form their functional equivalents are intended to be embraced by the claims.

I claim:

1. A method of constructing a masonry faced tilt-up or pre-cast concrete wall panel comprising:
- placing a positioning board on a level surface;
- applying an adhesive coating to the top surface of said positioning board;
- placing masonry units face-down on said adhesive coating;
- applying joint-control means to the space between said masonry units;
- placing a pouring form around the perimeter of said positioning board;
- placing reinforcing rods in position within said pouring form, above said masonry units;
- pouring concrete into said pouring form;
- causing said concrete to dry;
- removing said pouring form;
- tilting-up the resultant concrete wall panel;
- removing said positioning board from said resultant concrete wall panel;
- removing said adhesive from the face of said masonry units; then
- removing said joint-control means from between said masonry units to complete the construction of a masonry faced tilt-up or pre-cast concrete wall panel.

2. A method of constructing a masonry faced tilt-up or pre-cast concrete wall panel comprising:
- placing a positioning board on a level surface;
- applying an adhesive coating to the top surface of said positioning board;
- placing masonry units face-down on said adhesive coating;
- applying joint-control means to the space between said masonry units;
- placing a pouring form around the perimeter of said positioning board;
- placing reinforcing rods in position within said pouring form, above said masonry units;
- pouring concrete into said pouring form;
- causing said concrete to dry;
- removing said pouring form;
- tilting-up the resultant concrete wall panel;
- removing said positioning board from said resultant concrete wall panel; then
- simultaneously removing said adhesive from the face of said masonry units and removing said joint-control means from between said masonry units to complete the construction of a masonry faced tilt-up or pre-cast concrete wall panel.

3. A method of constructing a masonry faced tilt-up or pre-cast concrete wall panel comprising:
- placing a positioning board on a level surface;
- applying an adhesive coating to the top surface of said positioning board;
- placing a positioning means on top of said adhesive coating;
- placing masonry units face-down on top of said adhesive coating within said positioning means;
- removing said positioning means;
- applying joint-control means to the space between said masonry units;
- placing a pouring form around the perimeter of said positioning board;
- placing reinforcing rods in position within said pouring form, above said masonry units;
- pouring concrete into said pouring form;
- causing said concrete to dry;
- removing said pouring form;
- tilting-up the resultant concrete wall panel;
- removing said positioning board from said resultant concrete wall panel;
- removing said adhesive from the face of said masonry units; then
- removing said joint-control means from between said masonry units to complete the construction of a masonry faced tilt-up or pre-cast concrete wall panel.

4. A method of constructing a masonry faced tilt-up or pre-cast concrete wall panel comprising:
- placing a positioning board on a level surface;
- applying an adhesive coating to the top surface of said positioning board;
- placing a positioning means on top of said adhesive coating;
- placing masonry units face-down on top of said adhesive coating within said positioning means;
- removing said positioning means;
- applying joint-control means to the space between said masonry units;
- placing a pouring form around the perimeter of said positioning board;
- placing reinforcing rods in position within said pouring form, above said masonry units;
- pouring concrete into said pouring form;
- causing said concrete to dry;
- removing said pouring form;
- tilting-up the resultant concrete wall panel;
- removing said positioning board from said resultant concrete wall panel; then
- simultaneously removing said adhesive from the face of said masonry units and removing said joint-control means from between said masonry units to complete the construction of a masonry faced tilt-up or pre-cast concrete wall panel.

* * * * *